US006776804B2

(12) United States Patent
Crabtree et al.

(10) Patent No.: US 6,776,804 B2
(45) Date of Patent: Aug. 17, 2004

(54) PROCESS FOR PRINTING TEXTILE FABRICS

(75) Inventors: Alan Crabtree, Bradford (GB); Martin Lane, Heckmondwyke (GB); Ian George Potts, Eighton Banks Gateshead (GB); Leslie Walter Rouse, Ponteland (GB)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 10/152,244

(22) Filed: May 21, 2002

(65) Prior Publication Data

US 2003/0072952 A1 Apr. 17, 2003

(30) Foreign Application Priority Data

May 23, 2001 (EP) ..... 01112526
Dec. 18, 2001 (EP) ..... 01811240

(51) Int. Cl.[7] ..... D06P 5/08; C08L 83/08; C08L 75/04; B32B 25/20

(52) U.S. Cl. ..... 8/445; 8/494; 8/552; 8/581; 8/602; 516/55; 516/69; 516/102; 524/588; 524/590; 524/591; 428/423.1; 428/447; 442/157

(58) Field of Search ..... 428/423.1, 447; 516/55, 69, 102; 525/453, 474; 524/588, 590, 591; 442/157; 8/445, 494, 552, 581, 602

(56) References Cited

U.S. PATENT DOCUMENTS 3,652,198 A * 3/1972 Farber et al. ..... 8/480
3,867,171 A 2/1975 Ellsworth ..... 117/38
4,265,630 A * 5/1981 Bauerle ..... 8/456
4,598,120 A * 7/1986 Thoma et al. ..... 524/591
4,728,542 A * 3/1988 Nachtkamp et al. ..... 427/389
5,169,888 A * 12/1992 Sales ..... 524/267
5,360,456 A 11/1994 Lecomte et al. ..... 8/471
5,760,155 A * 6/1998 Mowrer et al. ..... 528/28
5,770,651 A * 6/1998 Traubel et al. ..... 524/591
5,961,906 A 10/1999 Müller et al. ..... 264/109
6,080,830 A 6/2000 Dirschl et al. ..... 528/45
2002/0121631 A1 * 9/2002 Rahman et al. ..... 252/500
2002/0178515 A1 * 12/2002 Moldenhauer et al. ..... 8/494
2003/0114058 A1 * 6/2003 Ishii et al. ..... 442/98

FOREIGN PATENT DOCUMENTS

EP 0890673 1/1999

OTHER PUBLICATIONS

English Translation of JP–02–091280, Hasegawa et al. Mar. 1990.*

Abstract for EP 0890673 (1999).

Patent Abstracts of Japan Publication No. 02091280 (1990).

Derwent Abstr. 1996–199057 [20] for KR 9407031 (1994).

* cited by examiner

*Primary Examiner*—Jeffrey B. Robertson
(74) *Attorney, Agent, or Firm*—Kevin T. Mansfield

(57) ABSTRACT

A printing paste containing:

(a) 5 to 25% by weight of a polyurethane, (b) 1.5 to 20% by weight of a silicone, (c) 0 to 50% by weight of a further component and (d) water as the remainder, the sum of the amounts of components (a)+(b)+(c)+(d) being 100%, is suitable for printing textile materials.

14 Claims, No Drawings

PROCESS FOR PRINTING TEXTILE FABRICS

Vast numbers of garments are produced every year.

The aesthetics of the garment are often enhanced by printing, for example, the manufacturer's logo or some other design onto the garment. This applies in particular to leisure wear, e.g. T-shirts. One of the principal features of leisure wear is comfort. This generally means that mostly very elastic, stretchable fabrics are used.

Printing T-shirts is an industry in its own right. With T-shirts, in particular, the design is generally printed onto the garment after it has been made up into a garment.

As with other clothing, the printed design has to be fast to rubbing and to washing.

It is normal to use pigments, as opposed to substantive dyes, as the colours in the prints, as the application processes for pigments are very much more straightforward and only require a fixation process after the printing. Substantive dye printing is more suited to printing long runs of fabric before it is made into individual garments.

In pigment printing, the pigment is applied together with a binder, which holds the pigments in place on the fabric. The binder is a clear, film-forming, flexible polymer that coats both the pigments and the fibres. The fixation process serves to allow the binder to spread out and then crosslink. The fixation process is generally a treatment at an elevated temperature for a short time,—e.g. 3 minutes at 150° C. After fixation, the binder is an insoluble film covering the surface of the fibres.

For woven fabrics, such as sheeting, shirting and most dress goods, there is a very limited amount of stretch in the fabric. These fabrics are often printed with pigments. The binders used for this purpose are nearly always based on polymers of acrylic esters or butadiene/acrylic ester copolymers. They give excellent fastness and a soft handle. However they are totally inadequate for printing on fabrics that have a high degree of stretch, such as knitted cotton interlock, as they do not stretch with the fabric and therefore crack when the fabric is stretched.

When the base fabric is very stretchable, as is usual for leisure wear, the printed mark must also be stretchable, or else it will either prevent the fabric from stretching and so greatly impair the aesthetic appeal of the garment, or else it will crack when the fabric is stretched and spoil the visual impact of the design. It is normal practice to use plastisol inks, i.e. inks which are based on polyvinyl chloride (PVC) emulsions, for this type of application.

For several reasons, however, there is a strong motivation in the industry to get away from compositions containing PVC.

Plastisol inks usually also contain plasticisers. These are present because PVC alone is a very rigid plastic and has to be softened or plasticised to give it the necessary degree of flexibility. The plasticisers are often phthalate esters and may be harmful to the environment. They may be leached out of the print during washing or may evaporate, particularly during drying in garment production processes or in household driers.

The normal plastisol inks also usually contain significant amounts of heavy metals, such as lead or cadmium, as stabilisers for the PVC which are often undesirable. Thus a strong demand exists in industry dealing with printing stretched textile material to find a method for printing such articles without the use of PVC, a plasticiser like e.g. phthalate esters and/or heavy metals.

JP-A 2-91280 discloses a binder composition for pigment printing containing a silicone emulsion and a polyurethane water dispersion or solution, which is said to reveal good fastness to rubbing and resistance to washing. However, with respect to open time in screen these formulations do not meet the highest requirements.

It has now surprisingly been found that the drying of the screen can be slowed down, i.e. the open time in screen can be increased, by using the inventive printing pastes containing specific amounts of a polyurethane emulsion binder, a silicone and optionally further components, e.g. a crosslinking agent.

The invention thus concerns a process for printing textile fabrics characterised in that the fabrics are treated with a printing paste containing a polyurethane, a silicone, optionally a pigment, water and optionally further components.

The printing pastes used in the inventive process are a further part of the invention. They contain:

a) 5 to 25% by weight of a polyurethane, b) 1.5 to 20% by weight of a silicone, c) 0 to 50% by weight of a further component and d) water as the remainder, the sum of the amounts of components (a)+(b)+(c)+(d) being 100%.

Preferred printing pastes contain:

a) 10 to 20% by weight, in particular 14 to 18% by weight, of a polyurethane, b) 2 to 15% by weight, in particular 2.5 to 5.0% by weight, of a silicone, c) 1 to 40% by weight, in particular 5 to 38% by weight, of a further component and d) water as the remainder.

The above % values refer to the pure amounts of urethane, silicone etc.

The polyurethanes are preferably used as stable aqueous polyurethane dispersions containing only small amounts (less than 3%) or no organic solvent.

In principle, all the well-known polyurethanes prepared by polyaddition of a di- or polyfunctional isocyanate and a di- or polyfunctional alcohol can be applied in the printing pastes according to the invention.

Preferably the polyurethanes are derived from aliphatic, cycloaliphatic, araliphatic or aromatic diisocyanates. Typical of such diisocyanate compounds are hexamethylene diisocyanate, biuret of hexamethylene diisocyanate, 2,2,4-trimethyl-hexamethylene diisocyanate, 1,4-diisocyanatocyclohexane, 4,4'-diisocyanatodicyclohexylmethane, isophorone diisocyanate, 1,3-cyclohexane bis(methylisocyanate), 1,4-diisocyanatobenzene, diphenylmethane diisocyanate in the form of its 2,2'-, 2,4'- and 4,4'-isomers, diisocyanatotoluene in the form of its 2,4- and 2,6-isomers and 1,5-diisocyanatonaphthalene.

The most preferred diisocyanates for the preparation of the polyurethanes suitable as component (a) are toluene diisocyanate, isophorone diisocyanate and, in particular, hexamethylene diisocyanate.

Di- or polyfunctional alcohols suitable for the preparation of polyurethanes are hydroxy-terminated polyethers and, in particular, hydroxy-terminated polyesters. Hydroxy-terminated polyesters can be prepared, for example, by the condensation of appropriate proportions of glycols and higher functionality polyols with dicarboxylic or polycarboxylic acids.

Some of the above urethanes and dispersions are commercially available.

Preferably, component (a) of the printing pastes according to the invention is an isocyanate-terminated reaction product of polyisocyanates and hydroxy-terminated polyesters, more specifically the polyaddition product of a diisocyanate and a polyester polyol produced by reacting a difunctional acid with an excess of a di- and/or tri-functional alcohol.

As the difunctional acid preferably succinic acid and especially adipic acid are used.

The di- and/or tri-functional alcohol may be an alkane diol or triol having 2 to 6 carbon atoms; these alcohols optionally can contain ether groups and/or can contain diamine components or polyether alcohols. All these compounds are well known in polyurethane chemistry. They are e.g. described in U.S. Pat. No. 5,961,906 in columns 1 and 2.

Preferably, the difunctional alcohol is ethylene glycol, propylene glycol, diethylene glycol, dipropylene glycol, polyethylene glycol or polyproylene glycol.

Especially useful is the urethane having the trade name Dicrylan PMC.

The silicones also are preferably used as stable aqueous dispersions. Such silicones are known as polyorganosiloxanes and are commercially available.

Preferred silicones are amino-functional polydimethyl siloxane emulsions, especially those having the trade name ULTRATEX FEW or ULTRATEX UM.

Further components which may be present in the printing pastes are e.g. natural or synthetic thickeners, pigments, acids, bases and/or salts to adjust the pH to the desired value, anionic, nonionic or cationic surfactants, antifoaming and antifrosting agents, dispersing agents, fixing agents, polyhydroxy compounds, reaction products of hydroxyl compounds and isocyanates, polyesters prepared by reaction of terephthalic acid and one or more polyethylene glycols. These components are commonly used or recommended for textile printing or finishing.

Suitable polyhydroxy compounds are e.g. ethylene glycol, propylene glycol, tetramethylene glycol, diethylene glycol, dipropylene glycol, polyethylene glycol, polypropylene glycol and polytetrahydrofuran.

In a further preferred embodiment the printing paste according to the invention contains as further component (c) 1 to 15% by weight, preferably 4 to 12% by weight, of ethylene glycol, propylene glycol, diethylene glycol, dipropylene glycol, polyethylene glycol or polyproylene glycol.

Particularly preferred are printing pastes according to the invention containing as further component (c) 1 to 10% by weight of an organic fixing agent.

Preferably organic fixing agents are used which are described in U.S. Pat. No. 6,080,830.

The organic fixing agent differs from standard reactive isocyanates used for this purpose in that the molecular structure is not based around a central polymer molecule. Desirably the fixing agent has a multiplicity of isocyanate groups arranged along a relatively small molecule. Generally the molecular weight will be below 10,000 and preferably below 5,000. In some cases the compound can have a molecular weight as low as a few hundred, but usually will be at least 1,000. More preferably the compound has a molecular weight in the range of 2,000 to 5,000, most preferably around 3,000 to 4,000.

The organic fixing agent may contain the aromatic components distributed throughout the molecule. Improved results are obtained when the isocyanate groups or the isocyanate precursor groups are bonded directly to an aromatic moiety. Preferably the compound additionally contains aromatic moieties distributed throughout each molecule of the fixing agent. This may be achieved by reacting an aromatic compound containing at least two functional groups, one of which must be an isocyanate with other multifunctional reaction species to provide a reaction product which contains aromatic species throughout the molecules and also free or isocyanate groups or precursor groups attached directly to an aromatic moiety. It may be desirable to use blocked or partially blocked aromatic isocyanates in preparing the compounds.

Preferably the organic fixing agent is obtainable by the following process steps:

a) reacting a diisocyanate or a mixture of diisocyanates (component I) with one or more alcohols having from 2 to 8 carbon atoms and/or with one or more mono- and/or diethers of such alcohols (component II), these alcohols or ethers thereof having at least two alcoholic hydroxyl groups and no more than two C—O—C bonds, and the reaction being carried out such that the product formed still has free isocyanate groups, b) reacting the product obtained in step a) with an organic amine containing two or more alcoholic hydroxyl groups, or a mixture of such amines, the reaction being carried out such that the product formed still has free isocyanate groups, with the proviso that at least one alcohol, one ether or one amine from amongst the alcohols, ethers and amines used in step a) and/or b) contains three or more alcoholic hydroxyl groups, c) blocking the free isocyanate groups of the product obtained in step b) by reaction with a blocking agent, d) dispersing the product obtained after step c) in water using one or more dispersants and adjusting the pH.

The isocyanate organic fixing agent may be prepared in accordance with the teachings of U.S. Pat. No. 6,080,830.

For an improved washability of the screen it is recommended to add small amounts (0.01 to 2% by weight, preferably 0.1 to 1.0% by weight, based on the total composition) of a polyester prepared by reaction of terephthalic acid and one or more polyethylene glycols, the polyethylene glycol(s) having a molecular weight of from about 200 to about 1500, to the printing paste.

The same effect can be achieved by pre-treatment of the screen with an aqueous solution of such a polyester.

The printing paste according to the invention preferably does not contain polyvinyl chloride or alkyl phthalates or heavy metals.

The printing paste can be applied in conventional manner using conventional equipment. Preferably, however, a multistage process is used to obtain perfect adhesion and/or to obtain special effects. In the first step a base coat, containing the components of the inventive printing paste, but no pigment, is applied to the textile material, which is then cured e.g. by heating. Afterwards the overprint is applied and the textile material is finished in the conventional way.

It is also possible to add pigment to the base coat, e.g. if a coloured top layer should be applied to a white or monochromatic background.

The prints obtained according to the invention are excellent. They are fast to washing and rubbing and are as flexible as prints made with plastisols.

The advantages are that PVC is eliminated from the printing system, there are no plasticisers or heavy metal stabilisers. At the end of its life the garment can be recycled safely and used e.g. in paper or other textile processes, or incinerated or dumped in landfill.

Accordingly, a further object of the invention is a method for printing textile material comprising the steps of applying at least one coat containing a printing paste according to the invention and optionally a pigment and curing the coat.

Preferably, the method for printing textile material comprises the steps of applying at least one base coat containing a printing paste according to the invention and optionally a pigment, curing the base coat, applying at least one overprint coat containing a printing paste according to the invention and a pigment, curing the overprint coat and finishing the textile material.

The inventive printing pastes are especially useful for printing textile material made of natural or synthetic polyamide, like nylon, perlon, silk or wool, viscose rayon or most preferably cotton.

The following non-limitative Examples illustrate the invention in more detail. Parts and percentages are by weight, unless otherwise stated.

In the Examples the following components are applied:

| | |
|---|---|
| PUR1: | a commercial polyurethane emulsion, sold for textile coating applications consisting of 50% polyurethane resin, 49.2% water and 0.8% organic solvent, the polyurethane is the polyaddition product of hexamethylenediisocyanate and a hydroxy-terminated polyester prepared from adipic acid and polyethylene glycol |
| Silicone 1: | a commercial silicone emulsion, sold for textile coating applications, consisting of 17.5% silicone, 5% of an ethoxylated alcohol and 77.5% water |
| Silicone 2: | a commercial silicone emulsion, sold for textile coating applications, consisting of 34% silicone, 5% of an ethoxylated alcohol and 61% water |
| Thickening agent: | a dispersion of a crosslinked poly(ammonium acrylate) commonly used as a thickener in pigment printing |
| Antifoam: | non-ionic antifoam for pigment and disperse printing applications (ALCOPRINT ® PA-NS, supplied by Ciba Specialty Chemicals) |
| Dispersing agent: | anionic dispersing agent for use in pigment printing (ALCOPRINT ® PDN, supplied by Ciba Specialty Chemicals) |
| Surfactant: | non-ionic surfactant ALCOPRINT ® PD-ER, supplied by Ciba Specialty Chemicals) |
| Fixing agent: | 40% aqueous emulsion of a branched aromatic polyurethane with terminal isocyanate groups blocked with butanone oxime, prepared according to Example 1 of U.S. Pat. No. 6,080,830. |
| PEG 400: | polyethylene glycol, molecular weight about 400 |
| PPG: | polypropylene glycol |

EXAMPLE 1

Standard 100% cotton interlock knitted T-shirts are printed on a carousel printing machine. The T-shirts are dyed to an orange shade.

A clear base (Table 1) is applied at the first station:

Make up of base coat:

The water is measured into a 5-liter beaker and stirred gently.

The polyurethane emulsion is weighed in.

The pH is adjusted to 8–9 by adding the ammonia.

The silicone is added and stirred in.

The thickener is added and the stirrer speed increased and maintained for 10 minutes until the mixture is homogenous and viscous.

The viscosity is measured with a Brookfield RVT rotary viscometer at 10 rpm, spindle #6.

The viscosity is 25000 cP.

The base coat is flash cured.

Then at a subsequent station an overprint (Table 1) is applied.

Make up of overprint:

The water is measured into a 5 liter beaker and stirred gently.

The polyurethane emulsion is weighed in, followed by the poly(sodium acrylate) solution, the non-ionic surfactant, polyethylene glycol and the antifoam.

The pH is adjusted to 8–9 by adding the ammonia.

The silicone emulsion is added.

The mixture is transferred to a homogeniser and the titanium dioxide added over a period of 10 minutes and left to disperse for 20 minutes so that the titanium dioxide is fully dispersed.

The thickener is added and the stirrer speed increased and maintained for 10 minutes until the mixture is homogenous and viscous.

The viscosity is measured straight away with a Brookfield RVT rotary viscometer at 10 rpm, spindle #6. The viscosity is 25000 cP. It is noticed that the viscosity increases when the paste is left standing for a time, but comes back to about 25000 cP on stirring.

The print is flash dried and then cured in a separate oven at 150° C. for 4 minutes.

Compared with the normal plastisol printed items, the T-shirts printed by the above process have superior stretch and washing fastness. The opacity and definition are equal or superior to those of prints made with a normal plastisol recipe.

TABLE 1

| Components | Clear base | Overprint |
|---|---|---|
| PUR1 | 300 g/kg | 350 g/kg |
| Silicone 1 | 250 g/kg | 150 |
| 30% aqueous ammonia | 5 g/kg | 5 g/kg |
| Thickening agent | 6 g/kg | 6 g/kg |
| Dispersing agent | | 5 g/kg |
| Surfactant | | 12 g/kg |
| Antifoam | | 1 g/kg |
| Diethylene glycol | | 60 g/kg |
| Titanium dioxide | | 350 |
| Water | 439 g/kg | 61 g/kg |

EXAMPLE 2

Example 1 is repeated but adding a blue pigment into the overprint recipe to give coloured prints.

The colours obtained are as bright as with the standard plastisol recipe, the washing fastness and stretch are superior and the definition and resolution of half tones are better.

EXAMPLE 3

Example 1 is repeated but the prints are made on white T-shirts. In this case, there is no need for the opacifiying agent, titanium dioxide. Pigments are added to the base coat and no overprint is used. The results are excellent—bright, sharp prints, with excellent washing and rubbing fastness and more than adequate stretch.

EXAMPLE 4

An orange coloured T-shirt is printed with the overprint recipe from Example 1, containing 350 g/kg of titanium dioxide. This is flash cured and then overprinted with the clear base from Example 1, with a blue pigment added.

This has the same components as in Example 2, but this time the white and blue are printed separately.

The blue print produced is much brighter and fuller than that obtained in Example 2.

The washing and rubbing fastnesses are excellent and the stretch is more than adequate.

EXAMPLE 5

The purpose of this example is to apply 2 coats of the white base on a very dark garment to achieve maximum opacity and brilliancy of whites plus superior brilliancy of any colours that are subsequently printed on top of the 2 coats of white:

A black coloured T-shirt is printed with the overprint recipe from Example 1, containing 350 g/kg titanium dioxide. This is flash cured and then overprinted a second time with the overprint recipe from Example 1 containing 350 g/kg titanium dioxide.

This is flash cured and a part is overprinted with the clear base from Example 1, with a blue pigment added. The whites so produced have equal opacity and brilliancy to those of prints made with a normal plastisol recipe. Overprinted colours are bright and full. The washing and rubbing fastness are excellent and the stretch is more than adequate.

EXAMPLE 6

Open Time in Screen:

An overprint composition is prepared from the components listed in Table 2

TABLE 2

| Components | Overprint |
|---|---|
| PUR1 | 300 g/kg |
| Silicone 2 | 45 g/kg |
| 30% aqueous ammonia | 5 g/kg |
| Thickening agent | 4 g/kg |
| Dispersing agent | 5 g/kg |
| Surfactant | 10 g/kg |
| Antifoam | 1 g/kg |
| PEG 400 | 60 g/kg |
| Fixing agent | 30 g/kg |
| Titanium dioxide | 300 g/kg |
| Water | 240 g/kg |

The formulation dries on screens in approximately 75 minutes and the dried film can be easily washed off the screen. This means a substantial extension of the open time in screen. Textiles printed by the above formulation have superior stretch and washing fastness.

EXAMPLE 7

Example 6 is repeated but adding 50 g/kg of propylene glycol. The open time in screen increases to 90–120 minutes.

EXAMPLE 8

An overprint composition is prepared from the components listed in Table 3

TABLE 3

| Components | Overprint |
|---|---|
| PUR1 | 350 g/kg |
| Silicone 2 | 75 g/kg |

TABLE 3-continued

| Components | Overprint |
|---|---|
| 30% aqueous ammonia | 5 g/kg |
| Thickening agent | 4 g/kg |
| Dispersing agent | 5 g/kg |
| Surfactant | 12 g/kg |
| Antifoam | 5 g/kg |
| Diethylene glycol | 60 g/kg |
| Dipropylene glycol | 50 g/kg |
| Titanium dioxide | 350 g/kg |
| Water | 84 g/kg |

The formulation dries on screens in 120 minutes and the dried film can be easily washed off the screen. This means a substantial extension of the open time in screen. Textiles printed by the above formulation have superior stretch and washing fastness.

EXAMPLES 9–16

The pastes described in Table 4 are prepared and applied as clear base on cotton fabric. The printed fabric is tested with respect to wash fastness.

Silicone 1 is added after both PUR1, water and ammonia to ensure that the polyurethane does not coagulate. The thickening agent is added with the aid of high speed stirring and finally, diethylene glycol is added using a Greaves Stirrer.

The prepared pastes are printed using the following conditions:

| | |
|---|---|
| Machine | Zimmer Flat Bed |
| Speed | 5 |
| Magnet | 3 |
| Bar | 10 mm |
| Screen | 100% Blotch |
| Fabric | White cotton interlock (Pastes 1–9 B and D)<br>Black cotton interlock (Pastes 1–9 A and C) |
| Dried | 100° C. for 1 minute in the Benz Stenter |

The paste below is then printed using the same conditions as above on top of the dried base coats

| Components | Overprint |
|---|---|
| PUR1 | 350 g/kg |
| Silicone 1 | 150 g/kg |
| 30% aqueous ammonia | 5 g/kg |
| Thickening agent | 40 g/kg |
| Dispersing agent | 5 g/kg |
| Surfactant | 12 g/kg |
| Antifoam | 1 g/kg |
| Diethylene glycol | 60 g/kg |
| Titanium dioxide | 350 g/kg |
| Water | 27 g/kg |

All the printed fabric is then cured at 150° C. for 4 minutes in the Benz stenter.

The wash fastness of the printed fabric is tested at 60° C. for 15 minutes using 135 g of Persil twin tub washing powder in the Hoover twin tub washer.

The results are summarised in Table 4; the amounts of the components are given in g/kg

TABLE 4

| Example | 9 | 10 | 11 | 12 | 13 | 14 | 15 | 16 |
|---|---|---|---|---|---|---|---|---|
| PUR1 | 450 | 450 | 450 | 300 | 300 | 300 | 150 | 150 |
| Silicone 1 | 300 | 200 | 100 | 300 | 200 | 100 | 300 | 100 |
| 30% aqueous ammonia | 5 | 5 | 5 | 5 | 5 | 5 | 5 | 5 |
| Thickening agent | 9 | 9 | 9.7 | 10.7 | 11.7 | 12.5 | 13.5 | 13.5 |
| Diethylene glycol | 60 | 60 | 60 | 60 | 60 | 60 | 60 | 60 |
| Water | 176 | 236 | 375.3 | 324.3 | 423.3 | 522.5 | 471.5 | 671.5 |
| Wash fastness | 4/5 | 4/5 | 4/5 | 4/5 | 4/5 | 4/5 | 4/5 | 4/5 |

EXAMPLES 17–22

The pastes described in Table 5 are prepared and applied on cotton fabric (without base coat). The printed fabric is tested with respect to wash fastness abd rub fastness.

Silicone 1 is added after both PUR1, water and ammonia to ensure that the polyurethane does not coagulate. The thickening agent is added with the aid of high speed stirring and finally, diethylene glycol and pigment (Unisperse® Red G) is added using a Greaves Stirrer. The prepared pastes are printed using the following conditions:

| | |
|---|---|
| Machine | Zimmer Flat Bed |
| Speed | 5 |
| Magnet | 3 |
| Bar | 10 mm |
| Screen | 100% Blotch |
| Fabric | White cotton interlock (Pastes 1–9 B and D)<br>Black cotton interlock (Pastes 1–9 A and C) |
| Dried | 100° C. for 1 minute in the Benz Stenter |

The rub fastness is tested in accordance with SMOT PS13.

TABLE 5

| Example | 17 | 18 | 19 | 20 | 21 | 22 |
|---|---|---|---|---|---|---|
| PUR1 | 450 | 450 | 300 | 300 | 150 | 150 |
| Silicone 1 | 100 | 100 | 200 | 200 | 100 | 100 |
| 30% aqueous ammonia | 5 | 5 | 5 | 5 | 5 | 5 |
| Thickening agent | 9.7 | 9.7 | 11.7 | 11.7 | 13.5 | 13.5 |
| Diethytene glycol | — | 60 | — | 60 | — | 60 |
| Pigment | 10 | 10 | 10 | 10 | 10 | 10 |
| Water | 425.3 | 365.3 | 473.3 | 413.3 | 721.5 | 661.5 |
| Dry Rub Fastness | 5 | 5 | 4/5 | 4/5 | 4 | 4 |
| Wet Rub Fastness | 4/5 | 4/5 | 3/4–4 | 3/4–4 | 3 | 3/4 |
| Wash fastness | 2 | 2/3–3 | 2–2/3 | 3 | 2/3 | 3/4 |

EXAMPLES 23–25

The pastes described in Table 6 are prepared and applied as base coat on cotton fabric. Subsequently, an overprint is applied as described in Example 1.

The printed cotton fabrics have superior stretch and washinhg fastness.

TABLE 6

| | Example | | |
|---|---|---|---|
| | 23<br>Clear Base | 24<br>Opaque Base | 25<br>White Base |
| PUR1 | 300 g/kg | 300 g/kg | 350 g/kg |
| Silicone 2 | 125 g/kg | 125 g/kg | 75 g/kg |
| 30% aqueous ammonia | 5 g/kg | 5 g/kg | 5 g/kg |
| Thickening agent | 6 g/kg | 6 g/kg | 4 g/kg |
| Dispersing agent | | 5 g/kg | 5 g/kg |
| Antifoam | | | 5 g/kg |
| Diethylene glycol | | | 60 g/kg |
| Propylene glycol | | | 50 g/kg |
| Titanium dioxide | | 150 g/kg | 350 g/kg |
| Water | 564 g/kg | 409 g/kg | 96 g/kg |

EXAMPLE 26

A design of 5 screens is selected. A 43 mesh base is used with 4 colours applied through 62 mesh. The Clear Base (composition according to Table 1, Example 1) and White Base (composition according to Table 3, Example 8) printing pastes are mixed with then pigments listed in Table 7 and a polyester prepared from terephthalic acid and a mixture of polyethylene glycols having a molecular weight of from about 200 to about 1500.

TABLE 7

| Component | Navy | Sky | Navy | Sky |
|---|---|---|---|---|
| Clear Base | 1000 g | 1000 g | — | — |
| White Base | — | — | 1000 g | 1000 g |
| Polyester | 5 g | 5 g | 5 g | 5 g |
| Unisperse ® Navy RT | 50 g | 0.5 g | 200 g | 5 g |
| Unisperse ® Green GL | | | 0.25 g | |
| Unisperse ® Yellow 2R | | | | 1.0 |
| Acramin Black | | | 20 g | |

26A: Colours in Clear Base

Screen Sequence: White Base, White Base, Flash, Navy, Navy, Flash, Sky, Sky, White White Excellent result with good coverage of all colours and excellent resistance to cracking on stretching.

26B: Colours in White Base

Screen Sequence: White Base, White Base, Flash, Navy, Flash, Sky, White, White

Excellent result with good coverage of all colours and excellent resistance to cracking on stretching, whites and colours dry on the screens but not in engravings.

The trial is repeated using an opaque paste created by mixing equal proportions of Clear and White Base navy colour. This gives equal colour and coverage to the navy prepared in the White base but displays far less tendency to dry out on the screen and does not require any attention after stoppages.

What is claimed is:

1. A printing paste containing:

(a) 5 to 25% by weight of a polyurethane, which polyurethane is a stable aqueous polyurethane dispersion containing only small amounts or no organic solvent, (b) 1.5 to 20% by weight of an amino-functional polydimethyl siloxane emulsion, (c) 0 to 50% by weight of a further component and (d) water as the remainder, the sum of the amounts of components (a)+(b)+(c)+(d) being 100%.

2. A printing paste according to claim 1 containing:

(a) 10 to 20% by weight of the polyurethane, (b) 2 to 15% by weight of an amino-functional polydimethyl siloxane emulsion, (c) 1 to 40% by weight of a further component and (d) water as the remainder.

3. A printing paste according to claim 1, wherein the polyurethane is the polyaddition product of a diisocyanate and a polyester polyol produced by reacting a difunctional acid with an excess of a di- and/or tri-functional alcohol.

4. A printing paste according to claim 3, wherein the polyurethane is the polyaddition product of a diisocyanate and a polyester polyol produced by reacting succinic acid or adipic acid with an excess of a di- and/or tri-functional alcohol.

5. A printing paste according to claim 3, wherein the polyurethane is the polyaddition product of a diisocyanate and a polyester polyol produced by reacting a difunctional acid with an excess of ethylene glycol, propylene glycol, diethylene glycol, dipropylene glycol, polyethylene glycol or polypropylene glycol.

6. A printing paste according to claim 3, wherein the polyurethane is the polyaddition product of hexamethylene diisocyanate, toluene diisocyanate or isophorone diisocyanate and a polyester polyol produced by reacting a difunctional acid with an excess of a di- and/or tri-functional alcohol.

7. A printing paste according to claim 1, wherein as further component(s) (c), one or more natural or synthetic thickeners, pigments, acids, bases and/or salts to adjust the pH, anionic, nonionic or cationic surfactants, antifoaming agents, antifrosting agents, dispersing agents, fixing agents, polyhydroxy compounds, reaction products of hydroxyl compounds and isocyanates or polyesters prepared by reaction of terephthalic acid and one or more polyethylene glycols are present.

8. A printing paste according to claim 1 containing as component (c) 1 to 15% by weight of ethylene glycol, propylene glycol, diethylene glycol, dipropylene glycol, polyethylene glycol or polypropylene glycol.

9. A printing paste according to claim 1 containing as component (c) 1 to 10% by weight of an organic fixing agent.

10. A printing paste according to claim 9 containing as organic fixing agent a blocked isocyanate obtained by the following process steps:

(A) reacting a diisocyanate or a mixture of diisocyanates (component I) with one or more alcohols having from 2 to 8 carbon atoms and/or with one or more mono- and/or diethers of such alcohols (component II), these alcohols or ethers thereof having at least two alcoholic hydroxyl groups and no more than two C—O—C bonds, said reaction being carried out such that the product formed still has free isocyanate groups, (B) reacting the product obtained in step (A) with an organic amine containing two or more alcoholic hydroxyl groups, or a mixture of such amines, the reaction being carried out such that the product formed still has free isocyanate groups, with the proviso that at least one alcohol, one ether or one amine from among the alcohols, ethers and amines used in step (A) and/or (B) contains three or more alcoholic hydroxyl groups, (C) blocking the free isocyanate groups of the product obtained in step (B) by reaction with a blocking agent, and (D) dispersing the product obtained after step (C) in water using one or more dispersants and adjusting the pH.

11. A printing paste according to claim 1, containing no polyvinyl chloride or alkyl phthalates or heavy metals.

12. A fabric or garment printed with a printing paste according to claim 1.

13. A method for printing textile material comprising the steps of applying at least one coat containing a printing paste according to claim 1 and optionally a pigment and curing the coat.

14. A method for printing textile material comprising the steps of applying at least one base coat containing a printing paste according to claim 1 and optionally a pigment, curing the base coat; then applying at least one overprint coat containing a printing paste according to claim 1 and a pigment, curing the overprint coat and finishing the textile material.

* * * * *